US008674794B1

(12) United States Patent
Oetjen et al.

(10) Patent No.: US 8,674,794 B1
(45) Date of Patent: Mar. 18, 2014

(54) HIGH SECURITY SWITCH DEVICE

(76) Inventors: Jennifer Oetjen, Gilbert, AZ (US); Randall Woods, Sun Lakes, AZ (US)

( * ) Notice: Subject to any disclaimer, the term of this patent is extended or adjusted under 35 U.S.C. 154(b) by 0 days.

(21) Appl. No.: 13/274,137

(22) Filed: Oct. 14, 2011

Related U.S. Application Data

(60) Provisional application No. 61/455,098, filed on Oct. 15, 2010.

(51) Int. Cl.
*H01H 9/00* (2006.01)

(52) U.S. Cl.
USPC ..... 335/205; 335/207

(58) Field of Classification Search
USPC ..... 335/205
See application file for complete search history.

(56) References Cited

U.S. PATENT DOCUMENTS

| | | | | |
|---|---|---|---|---|
| 5,332,992 | A * | 7/1994 | Woods | 340/547 |
| 5,530,428 | A * | 6/1996 | Woods | 340/547 |
| 5,673,021 | A | 9/1997 | Woods | |
| 5,880,659 | A | 3/1999 | Woods | |
| 5,997,873 | A | 12/1999 | Srivastava | |
| 6,104,265 | A * | 8/2000 | Maloney et al. | 335/13 |
| 6,506,987 | B1 * | 1/2003 | Woods | 200/61.62 |
| 6,803,845 | B2 * | 10/2004 | Woods | 335/207 |
| 7,023,308 | B2 * | 4/2006 | Woods | 335/205 |
| 7,187,259 | B1 * | 3/2007 | Habboosh | 335/205 |
| 7,218,194 | B2 * | 5/2007 | Habboosh | 335/205 |
| 7,248,136 | B2 * | 7/2007 | Habboosh | 335/205 |
| 7,291,794 | B2 * | 11/2007 | Woods | 200/61.62 |
| 7,518,478 | B2 * | 4/2009 | Habboosh | 335/205 |
| 7,800,468 | B2 * | 9/2010 | Bogdon et al. | 335/202 |
| 2001/0032841 | A1 * | 10/2001 | Fukushima et al. | 219/723 |

* cited by examiner

*Primary Examiner* — Shawki Ismail
*Assistant Examiner* — Lisa Homza
(74) *Attorney, Agent, or Firm* — Schmeiser, Olsen & Watts LLP

(57) ABSTRACT

A high security switch for use with an alarm includes a switch assembly for mounting to a fixed structural member. The switch assembly includes a pressure sensitive switch; a magnetic attractive movable body; a cavity having a first end and second end, the cavity confining, directing, limiting and defining the travel of the movable body; and a biasing element near the first end of the cavity to position the moveable body adjacent the first end of the cavity. The switch also includes an actuating element coupled to a movable structural member. In response to moving the actuating element away from the switch assembly the moveable body is magnetically acted upon by the biasing and moved from the second end to the first end of the cavity. The electrical state of the pressure sensitive switch is changed and an alarm activated.

8 Claims, 8 Drawing Sheets

HIGH SECURITY SWITCH DEVICE

CROSS REFERENCE TO RELATED APPLICATION[S]

This application claims priority to U.S. Provisional Patent Application to entitled "High Security Switch Device," Ser. No. 61/455,098, filed Oct. 15, 2010, the disclosure of which is hereby incorporated entirely herein by reference.

BACKGROUND OF THE INVENTION

1. Technical Field

This invention relates generally to a magnetic security switch for use with alarms and more particularly to a high security magnet switch for limiting defeat of the switch.

2. State of the Art

Prior art security alarm systems often make use of magnetic switches attached to doors and windows and integrated with the system for detecting unauthorized openings. One common type of magnetic switch used in these situations is a so-called reed switch. It has been found that reed switches are subject to unauthorized manipulation through use of an external magnet. Specifically, an intruder can hold a relatively strong magnet adjacent the reed switch which will then be operated (to either open or close depending on the control scheme). With this accomplished, an intruder can open the door or window without triggering the alarm system.

A number of magnetic switches have been proposed in the past to overcome the inherent deficiencies of reed switches. U.S. Pat. Nos. 6,506,987; 5,997,873; 5,530,428; 5,332,992; 5,673,021; and 5,880,659 describe switches of this type.

Each of these switches has its limitations, particularly in limiting the ability of an intruder to defeat the switch. Accordingly, there is a need for an improved high security switch.

DISCLOSURE OF THE INVENTION

The present invention relates to improved magnetic switches for detecting relative movement between moveable structural member and fixed structural member such as a door and door frame or a window and window frame, and normally are used to detect when the moveable member is moved from a first position in close adjacency with the fixed structural member, to a second position where the moveable structural member is moved to a second position creating at least a partial separation from the fixed structural member.

Generally, the magnetic switches of embodiments of the present invention may include a switch assembly for mounting to a fixed structural member. The switch assembly may comprise a pressure sensitive switch; a magnetic attractive movable body; a cavity having a first end and second end, the cavity confining, directing, limiting and defining the travel of the movable body; a biasing element near the first end of the cavity to position the moveable body adjacent the first end of the cavity and a permanent actuating element coupled to a movable structural member. The cavity may be angled to create a sloped cavity wherein the first end is higher than the second end and the moveable body can travel substantially linearly between the first end and the second end. In this configuration, as the actuating element is moved away from the moveable body, the moveable body is acted upon by the biasing element and the moveable body moves from the second end to the first end. In this way, a change in the state of the pressure sensitive switch is registered and an alarm may sound.

Another embodiment includes a method of using a high security switch with an alarm system. The method comprises mounting a switch assembly to a fixed structural member; mounting an actuating member to a moveable structural member; positioning the actuating member adjacent the switch assembly; maintaining a pressure switch of the switch assembly in a second electrical state in response to positioning the actuating member adjacent the switch assembly; moving the actuating member away from the switch assembly; changing the pressure sensitive switch from the second electrical state to a first electrical state in response to moving the actuating member away from the switch assembly; and activating an alarm in response to the pressure sensitive switch being moved to the first electrical state.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to improved magnetic switches for detecting relative movement between moveable structural member and fixed structural member such as a door and door frame or a window and window frame, and normally are used to detect when the moveable member is moved from a first position in close adjacency with the fixed structural member, to a second position where the moveable structural member is moved to a second position creating at least a partial separation from the fixed structural member.

Figure 1:
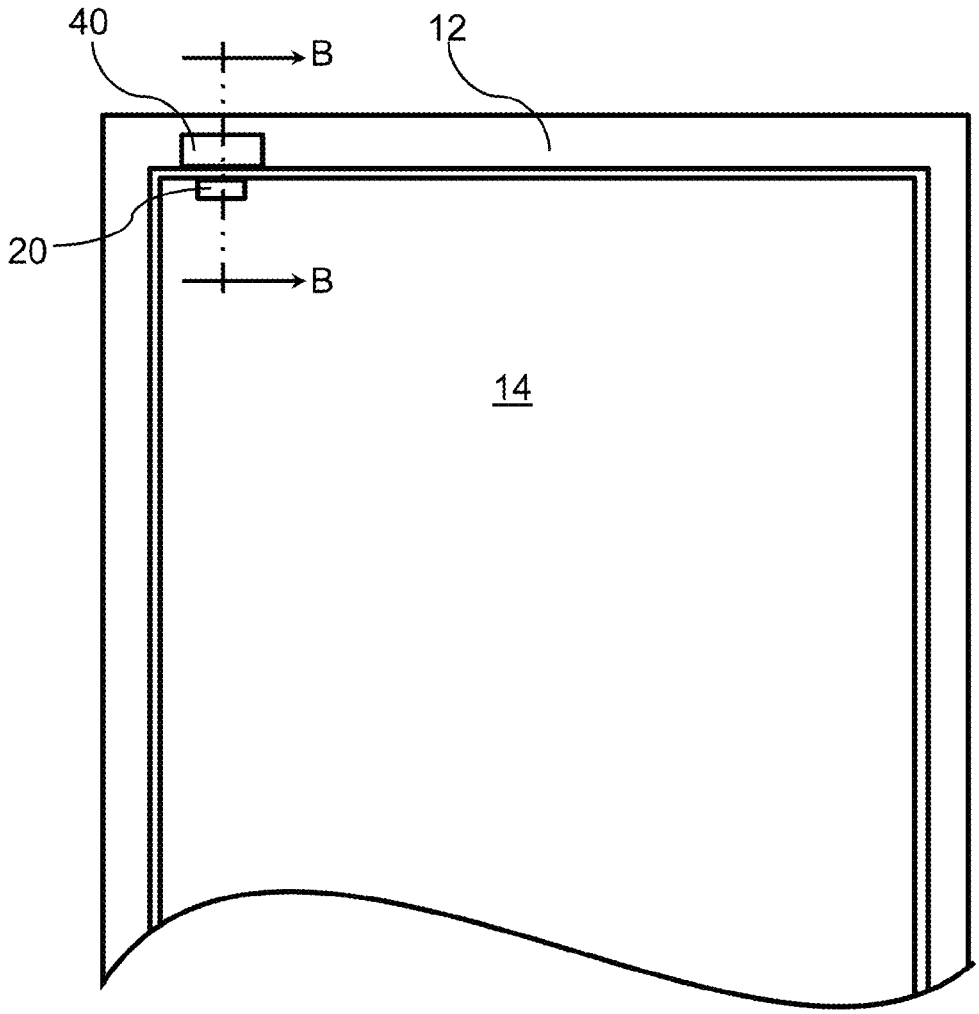
FIG. 1 is front view of a high security switch.
Figure 2:
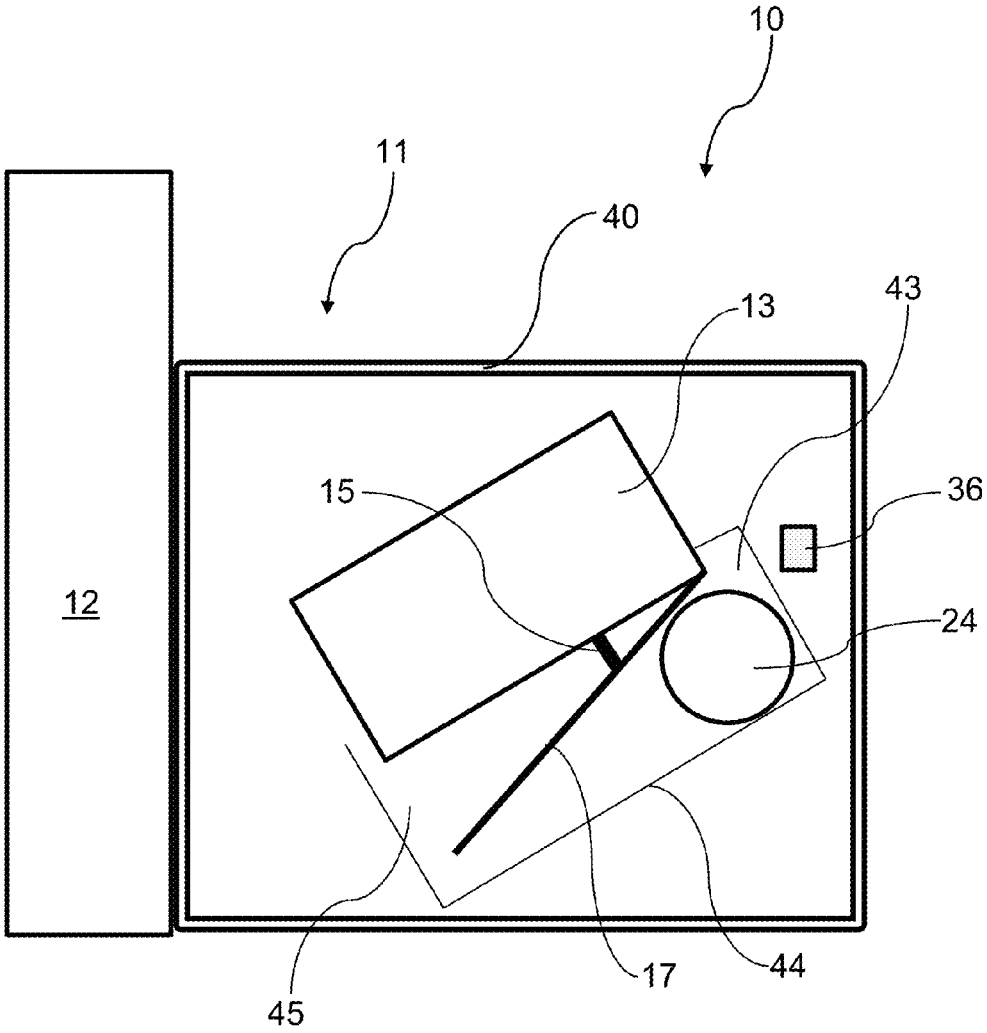
FIG. 2 is a side section view of the high security switch of FIG. 1A, taken along line B-B, with the switch in a first electrical state.
Figure 3:
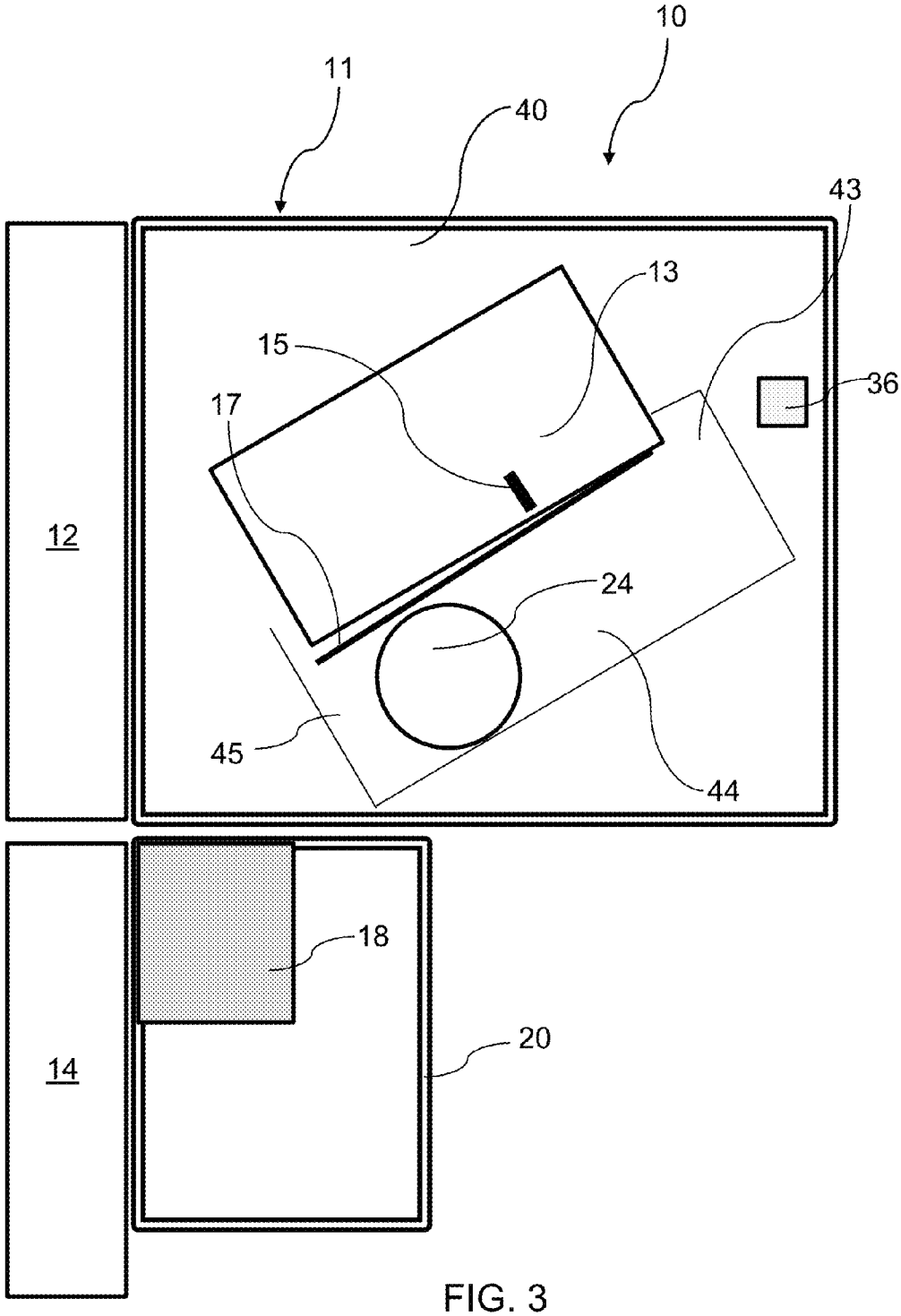
FIG. 3 is another side section view of the high security switch of FIG. 1A, taken along line B-B with the switch in a second electrical state.

Referring to the drawings, FIG. 1-3 shows a high security switch 10 in accordance with particular embodiments of the present invention. The switch 10 comprises a switch assembly 11 and an actuating element 18. The switch assembly 11 may include an enclosure 40 coupled to a fixed structural element 12 and an actuating element 18 within a housing 20 coupled to a moveable structural element 14. Retained within the enclosure 40, the assembly 11 further comprises a pressure sensitive switch 13; a magnetic attractive movable body 24; a cavity 44 having a first end 43 and second end 45, the cavity 44 confining, directing, limiting and defining the travel of the movable body 24 within the cavity 44; and a biasing element 36 near the first end 43 of the cavity 44 to position the moveable body 24 adjacent the first end of the cavity 44 when an actuating element is not adjacent the enclosure 40. The actuating element 18 coupled to a movable structural member 14. The enclosure 40 may be formed of essentially non-magnetic material so as not to interfere with the action of the actuating element 18 on moveable body 24.

The pressure sensitive switch 13, in some embodiments, comprises a lever arm 17 and a switch actuator 15. The lever arm 17 is in a first position by the normal internal spring force of pressure sensitive switch 13. Switch actuator 15 is in a first position and the electrical state of switch 13 is in a first electrical state either a closed electrical path or an open electrical path as preferred. The pressure sensitive switch 13 may be coupled in a fixed position within cavity 44. The biasing element 36 magnetically attracts body 24 to cause it to be moved to the first end 43 of the cavity 44 to a first position, thereby putting the lever arm 17 and the switch actuator 15 into a first position that corresponds to a first electrical state of the switch 13. This occurs when the actuating element 18 is moved away from the enclosure 40.

When the actuating element 18 is moved adjacent the enclosure 40, the magnetic influence of an actuating element 18 has a stronger magnetic influence on the moveable body 24 than the biasing element 36. Accordingly, the moveable body 24 is moved from the first end 43 of the cavity 44 to the second end 45 of the cavity 44. The pressure sensitive switch 13 and cavity 44 are positioned within said housing so as to allow the actuating element 18 to attract the movable body 24 to the second end 45 within the cavity 44 and thus move the moveable body 24 a certain distance from, but not out of the influence of, the biasing element 36. In response to movement of the moveable body from the first end 43 to the second end 45 of the cavity, the moveable body 24 engages the lever arm 17 and moves the lever arm 17, and consequently the switch actuator 15 into a second position and the electrical state of switch 13 is then in a second electrical state either a closed electrical path or an open electrical path as preferred.

In these embodiments, the first electrical state of switch 13 corresponds to triggering the alarm and the second electrical state of switch 13 corresponds to a safe condition.

In these particular embodiments, the enclosure 40 with its contents may be mounted to a door frame 12 and the actuating element 18, which may be a magnet, is mounted to a door 14, such that when the door is closed, the actuating element 18 is adjacent the enclosure 40.

Figure 4:
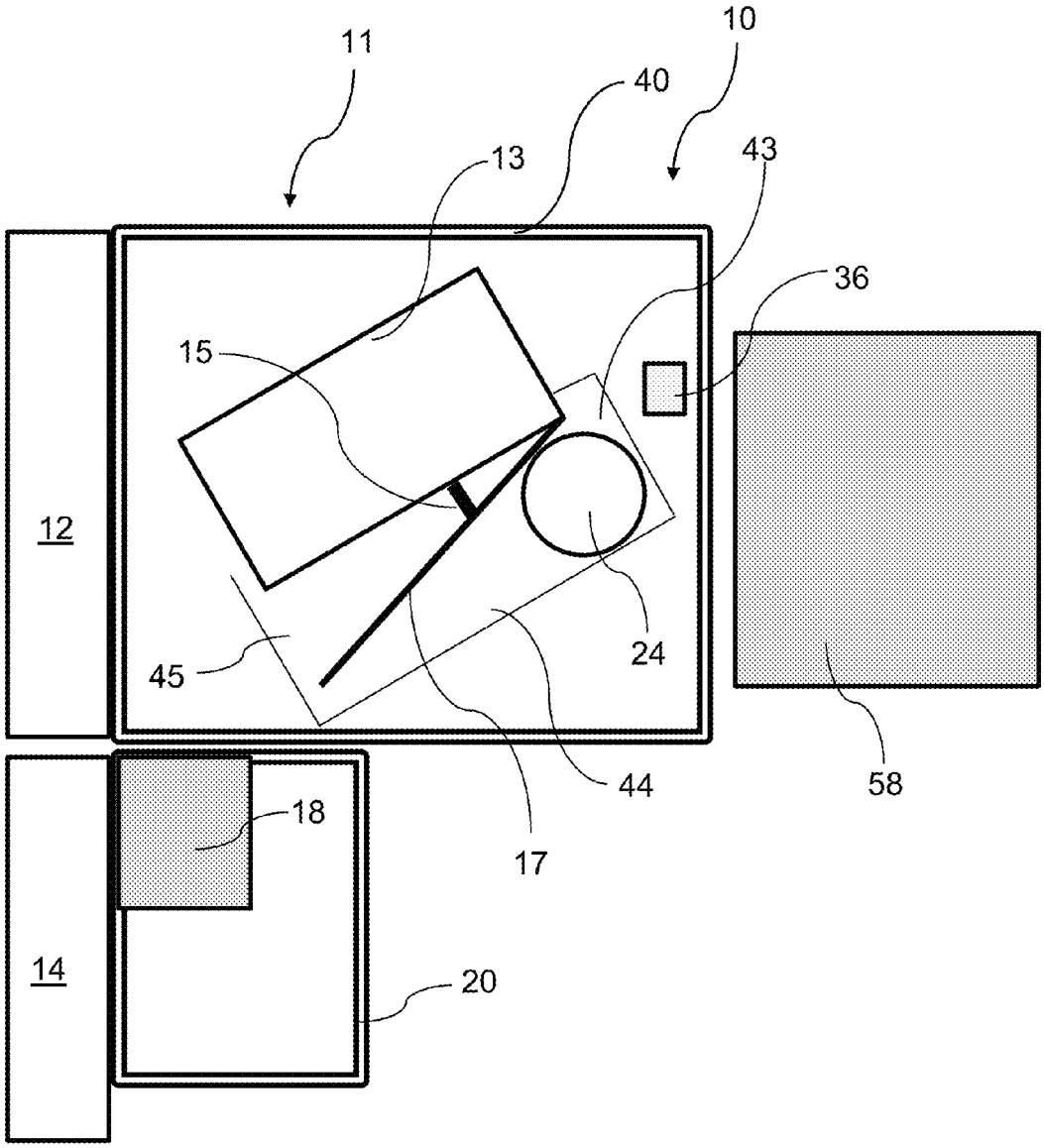
FIG. 4 is a side section view of the high security switch of FIG. 1A, taken along line B-B, with a defeat magnet.

Referring additionally to FIG. 4 depicts an attempt at using a defeat magnet 58 to defeat the alarm high security switch. By placing a defeat magnet 58 adjacent the enclosure 40 that may cause the moveable body 24 to be moved to the first end 43 within the cavity 44 and pressure switch 13 to a first electrical state associated with triggering the alarm if the defeat magnet 58 has a stronger influence on the ball than the actuating element 18, even though the door is closed and the actuating element 18 is in a proper position. It should be appreciated that a plurality of positions around the assembly are possible to position a defeat magnet 58 that causes the alarm to be triggered.

Figure 7:
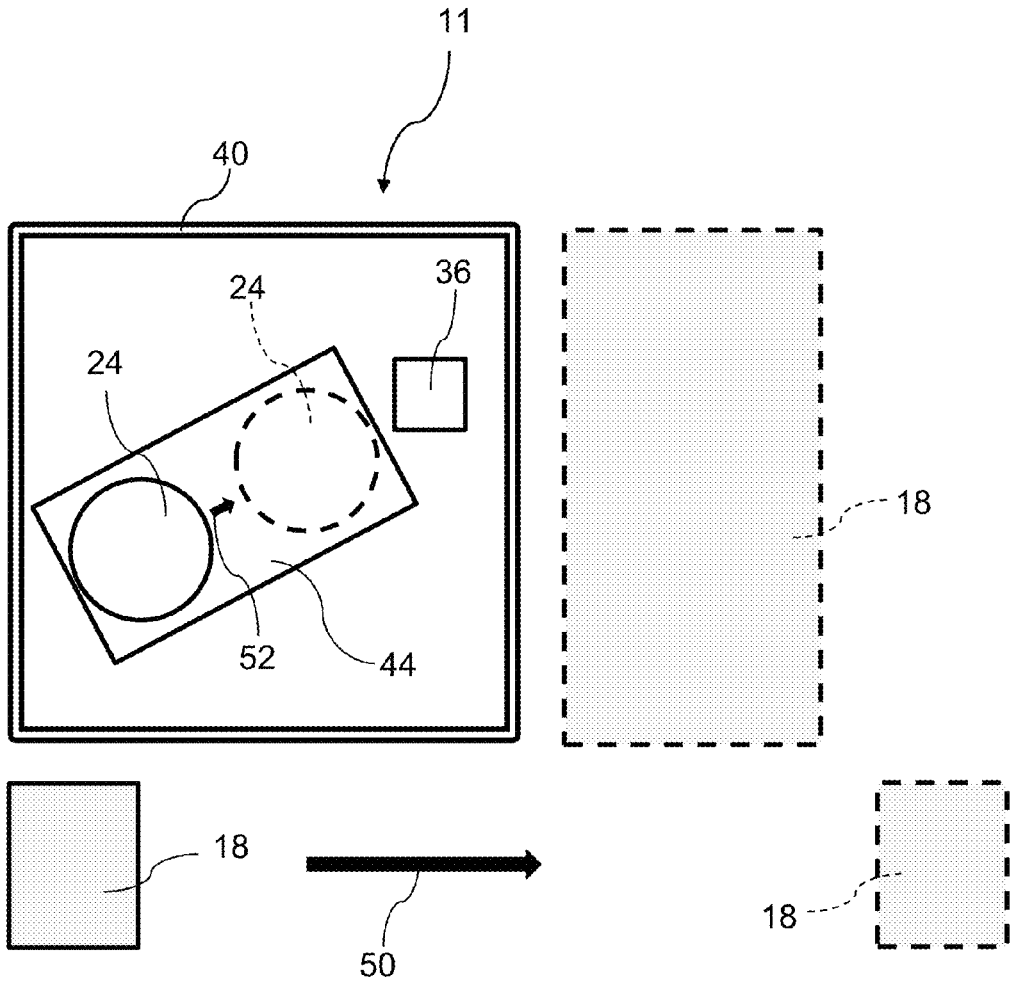
FIG. 7 is a schematic depiction of a high security switch when an external magnet is introduced or when the actuating element is moved from adjacency with the high security switch.

Additionally, FIG. 7 shows schematically what occurs if an intruder attempts to use an external magnet 58 in an attempt to defeat switch 10, the body 24 is moved because of the magnetic attraction between the magnet 58 and the body 24 to the dashed line position. This moves the switch 13 to first electrical state serving to trigger the alarm circuit. Consequently, any such attempt to defeat the switch 10 will immediately set off the alarm.

Further, FIG. 7 depicts how the actuating element 18 functions to assist in the moving of the moveable body 24 from the second end to the first end of the cavity 44. As the actuating element 18, such as, but not limited to a magnet, is moved along direct arrow 50, the magnetic attraction between the moveable body 24 and the actuating element 18 is still in operation, causing the moveable body 24 to continue its attraction to the actuating element 18. Because of the slope of the cavity 44, the moveable body begins to move up the slope in the direction of arrow 52, closer to the biasing element 36. Once the actuating element 18 is moved a distance away where the magnetic attraction of the biasing element 36 is stronger than the actuating element 18, the moveable body 24 is continues to travel in direction 52 until it is located and retained at the first end of the cavity 44 by the attraction of the moveable body 24 to the biasing element 36. The reverse occurs when the actuating element 18 is moved back into an adjacent position to the switch assembly 11, the actuating element 18 has a stronger magnetic attraction with the moveable body 24, thereby moving the moveable body down the slope of the cavity 44 until it is located and retained in the second end of the cavity 44.

Figure 5:
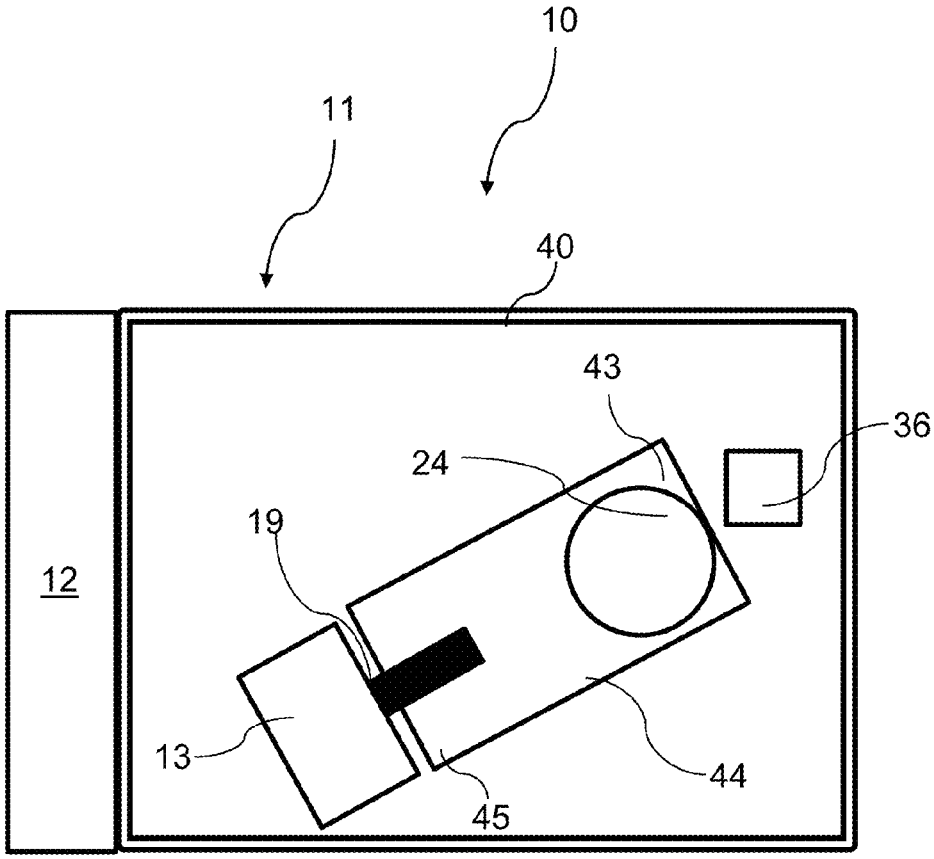
FIG. 5 is a side section view of the high security switch wherein the switch is a push button switch at an end of the cavity, the switch being in a first electrical state.
Figure 6:
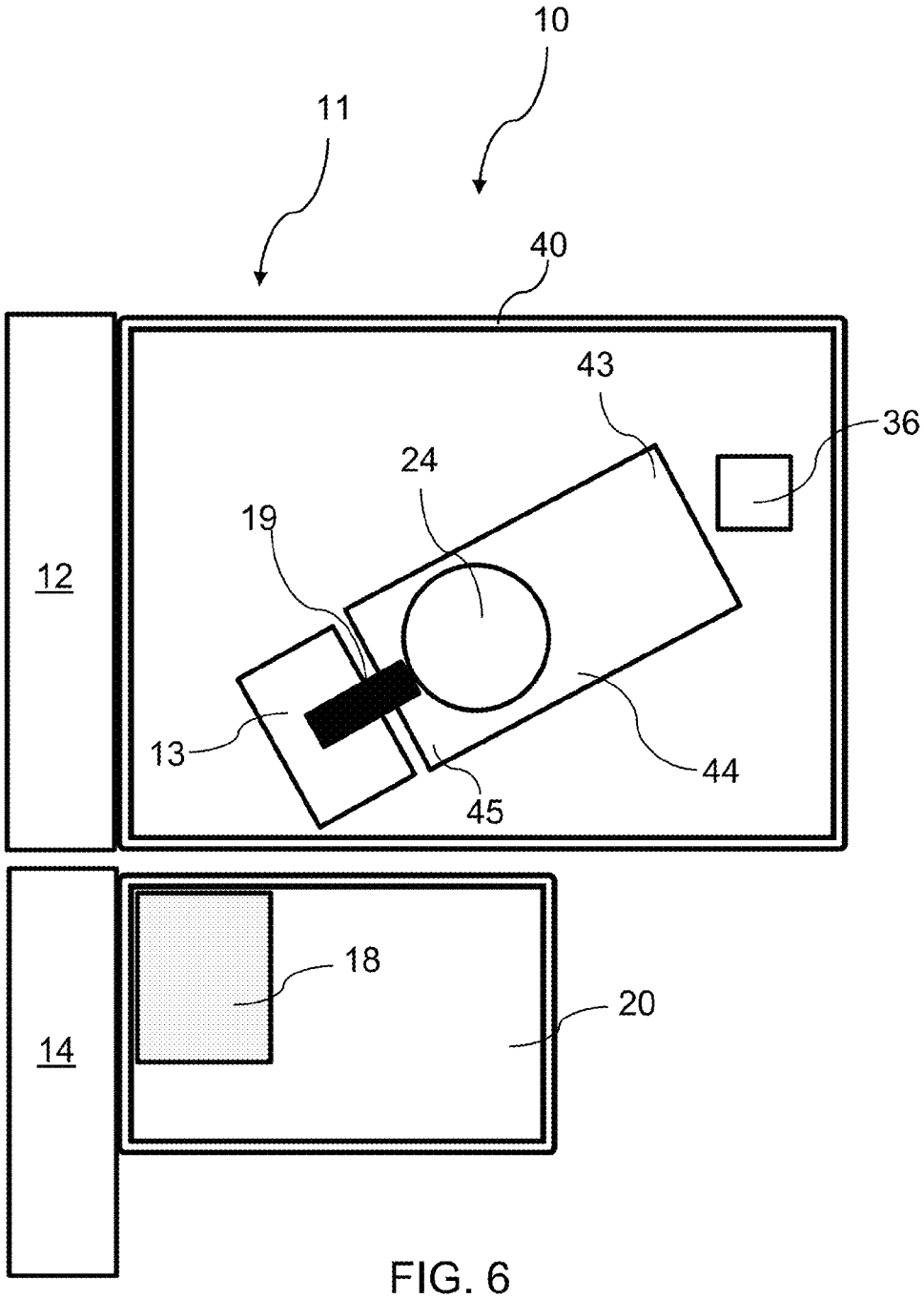
FIG. 6 is a side section view of the high security switch of FIG. 4 with the switch in a second electrical state.

Referring again to the drawings, FIGS. 5 and 6 depict another embodiment of a high security switch assembly 11 with a pressure sensitive switch 13 with a push button 19 located at the second end 45 of the cavity 44. In these embodiments, the pressure sensitive switch 13 may be coupled in a fixed position within cavity 44. The biasing element 36 magnetically attracts body 24 to cause it to be moved to the first end 43 of the cavity 44 to a first position, thereby releasing pressure on the push button 19 and moving the push button into a first position that corresponds to a first electrical state of the switch 13. This occurs when the actuating element 18 is moved away from the enclosure 40.

When the actuating element 18 is moved adjacent the enclosure 40, the magnetic influence of an actuating element 18 has a stronger magnetic influence on the moveable body 24 than the biasing element 36. Accordingly, the moveable body 24 is moved from the first end 43 of the cavity 44 to the second end 45 of the cavity 44. The pressure sensitive switch 13 and cavity 44 are positioned within said housing so as to allow the actuating element 18 to attract the movable body 24 to the second end 45 within the cavity 44 and thus move the moveable body 24 a certain distance from, but not out of the influence of, the biasing element 36. In response to movement of the moveable body from the first end 43 to the second end 45 of the cavity, the moveable body 24 engages the push button 19 into a second position and the electrical state of switch 13 is then in a second electrical state either a closed electrical path or an open electrical path as preferred.

Figure 8:
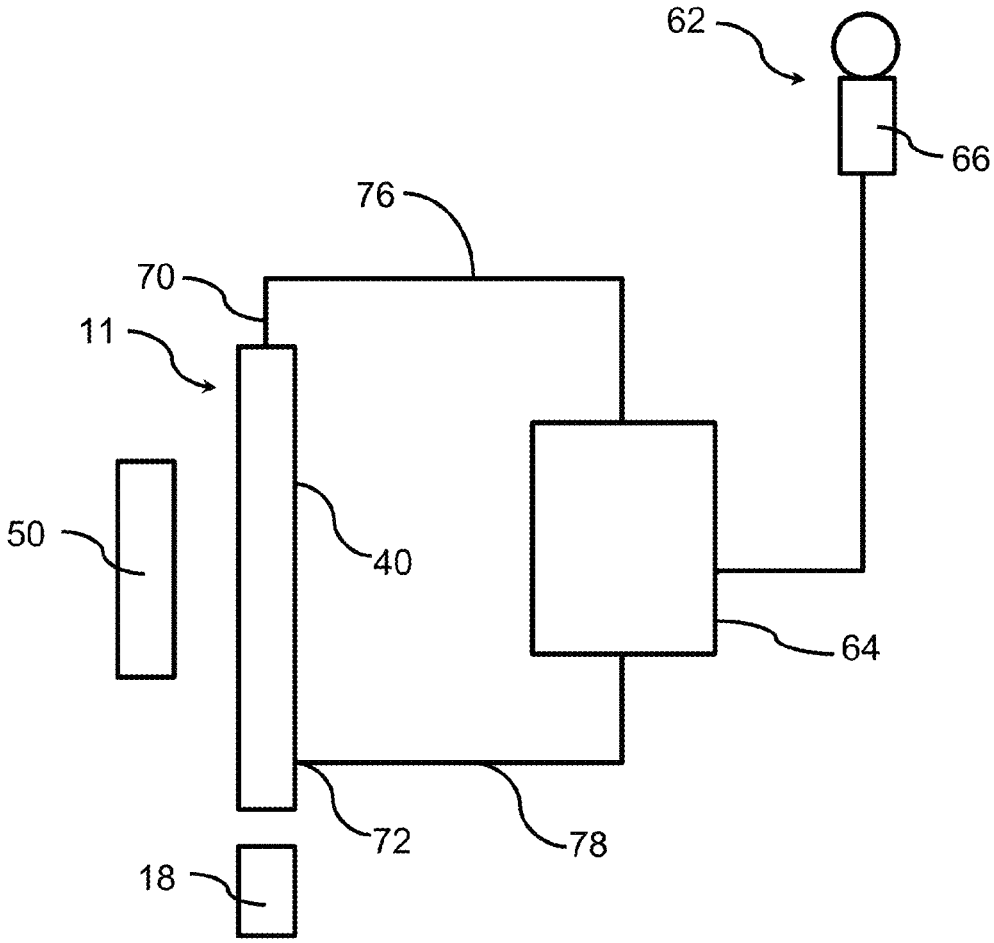
FIG. 8 is a schematic depiction of an alarm system using the high security switch.

FIG. 8 illustrates a hookup of switch assembly 11 within an alarm circuit 62. In particular, the housing 40 is electrically coupled with a conventional alarm control 64, that is lead 76 is operatively coupled with first switch element 70 and lead 78 is coupled with the second switch element 72, with both leads connected to control 64. An alarm bell 66 or similar output device is connected with control 64.

It will be appreciated that the relative strengths or magnetic susceptibilities of the actuating elements 18 and the biasing element 36 must be considered in the design of switch assembly 11. That is, the magnetic attraction generated between the body 24 and actuating element 18 when the door 14 is closed must be significantly stronger than the countervailing magnetic attraction between the body 24 and the biasing element 36.

As also shown in FIG. 7, if an intruder attempts to use an external magnet 58 in an attempt to defeat switch 10, the body 44 is moved because of the magnetic attraction between the magnet 58 and the body to the dashed line position, which again is a switch-open orientation serving to trigger the alarm circuit 52. Consequently, any such attempt to defeat the switch 10 will immediately set off the alarm.

While it is shown that the switch assembly is coupled to the fixed structural member, and the actuating element is coupled to the moveable structural member, it will be understood that under some circumstances the location may be exchanged and not deviate from the scope of the claims.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, the high security switch my further comprise a pry tamper detection switch to limit the opportunity of removal of the switch without detection.

The invention claimed is:

1. A high security switch for use with an alarm comprising:

a switch assembly for mounting to a fixed structural member, the switch assembly comprising:

a pressure sensitive switch comprising a lever arm engaging a switch actuator, wherein the switch actuator is moveable between a first and a second position in response to moving the lever arm between a first and second position;

a magnetic attractive movable body;

a cavity having a first end and second end, the cavity confining, directing, limiting and defining the travel of the magnetic attractive movable body; and a biasing element near the first end of the cavity to position the moveable body adjacent the first end of the cavity; and an actuating element coupled to a movable structural member, wherein:

in response to moving the actuating element is away from the switch assembly the magnetic attractive moveable body is magnetically acted upon by the biasing element to move the magnetic attractive moveable body from the second end to the first end of the cavity allowing the lever arm and the switch actuator to move to the first position and activating an alarm; and in response to moving the actuating element toward the switch assembly the moveable body is magnetically acted upon by the actuating element to move the moveable body to the second end of the cavity, wherein the magnetic attractive moveable body engages the lever arm and moves the lever arm and the switch actuator to the second position.

2. The switch of claim 1, wherein the cavity is angled to create a sloped cavity wherein the first end is higher than the second end and the moveable body can travel substantially linearly between the first end and the second end.

3. The switch of claim 2, wherein the cavity is sloped upwardly and outwardly from the fixed structural member.

4. The switch of claim 1, wherein the actuating element comprises a stronger magnetic influence on the moveable body than the biasing element.

5. The switch of claim 1, wherein the moveable body is moved from the second end to the first end of the cavity in response to placing an external magnet adjacent a switch assembly.

6. A method of using a high security switch with an alarm system comprising:

mounting a switch assembly to a fixed structural member;

mounting an actuating member to a moveable structural member;

positioning the actuating member adjacent the switch assembly;

maintaining a pressure sensitive switch of the switch assembly in a second electrical state in response to positioning the actuating member adjacent the switch assembly, wherein the pressure sensitive switch comprising a lever arm engaging a switch actuator, wherein the switch actuator is moveable between a first and a second position in response to moving the lever arm between a first and second position;

moving the actuating member away from the switch assembly;

changing the pressure sensitive switch from the second electrical state to a first electrical state in response to moving the actuating member away from the switch assembly allowing the lever arm and the switch actuator to move to the first position; and activating an alarm in response to the pressure sensitive switch being moved to the first electrical state.

7. The method of claim 6, further comprising placing an external magnet adjacent the switch assembly.

8. The method of claim 7, further comprising changing the pressure sensitive switch from the second electrical state to a first electrical state in response to placing the external magnet adjacent the switch assembly.

* * * * *